United States Patent [19]

Reed et al.

[11] 4,346,485

[45] Aug. 31, 1982

[54] APPARATUS AND METHOD FOR BATHING INVALIDS

[75] Inventors: Stewart D. Reed, El Toro, Calif.; Arthur A. Sills, Traverse City, Mich.; John H. Kraft, Traverse City, Mich.; Raymond T. Houle, Traverse City, Mich.; Michael A. Redwine, Acme, Mich.; Frederick A. Kilbourn, Suttons Bay, Mich.

[73] Assignee: Silchor, Traverse City, Mich.

[21] Appl. No.: 187,522

[22] Filed: Sep. 15, 1980

[51] Int. Cl.[3] ..... A47K 3/02

[52] U.S. Cl. ..... 4/555; 4/538; 4/556; 4/601

[58] Field of Search ..... 4/555, 556, 557, 558, 4/552, 538, 596, 601

[56] References Cited

U.S. PATENT DOCUMENTS

| | | |
|---|---|---|
| D. 143,204 | 12/1945 | Fleischhauer . |
| 2,081,728 | 5/1937 | Bassett . |
| 2,569,825 | 10/1951 | Otis . |
| 2,570,053 | 10/1951 | Fowler et al. . |
| 2,576,623 | 11/1951 | McLaughlin . |
| 2,587,335 | 2/1952 | Landergott . |
| 2,804,629 | 9/1957 | Ring . |
| 2,936,463 | 5/1960 | Tracy . |
| 2,977,604 | 4/1961 | Miller . |
| 3,066,316 | 12/1962 | Russell . |
| 3,113,323 | 12/1963 | Beardsley . |
| 3,270,353 | 9/1966 | Berthelsen et al. . |
| 3,366,978 | 2/1968 | Jones . |
| 3,371,354 | 3/1968 | Hayslett . |
| 3,371,357 | 3/1968 | Berthelsen et al. . |
| 3,380,078 | 4/1968 | Hanson . |
| 3,416,166 | 12/1968 | Hanson . |
| 3,423,769 | 1/1969 | Cowley . |
| 3,467,969 | 9/1969 | Szekely . |
| 3,496,579 | 2/1970 | Petersen . |
| 3,562,821 | 2/1971 | Queen . |
| 3,604,018 | 9/1971 | Moran . |
| 3,662,409 | 5/1972 | Johansson . |
| 3,663,971 | 5/1972 | Bonhote . |
| 3,703,733 | 11/1972 | McLoughlin . |
| 3,719,960 | 3/1973 | Russell . |
| 3,736,924 | 6/1973 | Jacuzzi et al. . |
| 3,815,163 | 6/1974 | Sullivan . |
| 3,827,086 | 8/1974 | Seymour et al. . |
| 3,827,087 | 8/1974 | Cuthbertson . |
| 3,863,275 | 2/1975 | Brendgord et al. . |
| 3,879,770 | 4/1975 | Grant . |
| 3,900,906 | 8/1975 | Berthelsen . |
| 3,924,278 | 12/1975 | Ekman . |
| 4,067,071 | 1/1978 | Altman et al. . |
| 4,080,710 | 3/1978 | Hess . |
| 4,099,272 | 7/1978 | Sowder . |
| 4,118,810 | 10/1978 | Brickhouse et al. . |
| 4,160,292 | 7/1979 | Kuether et al. . |

FOREIGN PATENT DOCUMENTS

| | | | |
|---|---|---|---|
| 1226206 | 3/1971 | United Kingdom | 4/555 |

*Primary Examiner*—Henry K. Artis

*Attorney, Agent, or Firm*—Price, Heneveld, Huizenga & Cooper

[57] ABSTRACT

An arrangement for bathing invalids, or others with impaired ambulatory ability, comprises an enclosure having a bathtub with upstanding walls which form a stall. The bathtub includes a seat having an anatomical contour and a lateral opening adjacent the seat to permit invalid ingress and egress. A door with a generally wedge-shaped contour mates with and selectively closes the bathtub opening, and includes a seal compressed between the opening lip and the door to form a seal which is sufficiently leakproof to permit immersal bathing of a seated invalid. The door is slideably mounted on a hingeless track assembly, which vertically translates the door into the closed position and pivots the door as it is raised into a horizontal, overhead storage position. Shower heads are mounted on the walls of the stall to provide both shower and immersal bathing for hygiene and therapy. The bathtub seat and opening are mutually oriented so as to permit an attendant to laterally move the invalid from a wheelchair directly onto the bathtub seat with minimum strain and hazard.

17 Claims, 7 Drawing Figures

APPARATUS AND METHOD FOR BATHING INVALIDS

CROSS REFERENCE TO RELATED APPLICATIONS

The present application is related to my copending U.S. design patent application Ser. No. 187,337, filed Sept. 15, 1980, entitled BATHTUB.

BACKGROUND OF THE INVENTION

The present invention relates to bathing devices, and in particular to an arrangement for bathing invalids and others with impaired ambulatory ability.

The bathing of invalids in hospitals, nursing homes, convalescent and retirement centers, home care units, and other similar institutions and facilities is a very serious and difficult problem. Recent surveys have indicated that there are literally millions of people in the United States with physical impairments which are sufficiently severe to require other than conventional bathing facilities. Quadriplegics, paraplegics, amputies, birth defected, mentally handicapped, stroke victims, arthritics, heavily medicated, aged or terminally ill patients are examples of just some of those who typically require specialized bathing. Regular bathing is essential not only for the hygiene of the patient, but is also used extensively as a treatment, and in conjunction with various types of therapeutic procedures. Because of their physical impairment, many invalids are relegated to sponge baths, and to the indignity of having another person bathe them.

The use of conventional bathtubs for bathing invalids and other handicapped persons who experience difficulty getting into and out of a normal bathtub, is generally considered impractical because of the hazard of injury to the patient and the extensive supervision and assistance required. Attendants find that the physical labor involved in transferring a patient from a wheelchair into an ordinary type of bathtub is not only very tiresome and strenuous, but also very dangerous to the patient, as the hazard of slipping or otherwise falling is quite high in tiled, wet bathing areas. Since some infirm patients are unable to step over the edge of a conventional bathtub, or even negotiate the small step at the entrance of a shower enclosure without assistance, attendants must be available at all times, and closely supervise all patient bathing.

Heretofore, various structures have been devised for bathing invalids, including chair lifts for bathtubs, sliding seat shower stalls, and the like. However, these devices are typically quite expensive to manufacture, require substantial floor space to operate, and do not appreciably alleviate the safety hazards associated with the transference of the patient in and out of the bathing unit. These devices have a complicated construction which is quite difficult to repair and maintain. Also, some of the prior bathing units, particularly those of the chair lift type, are quite intimidating to the patient, uncomfortable, and often considered somewhat dehumanizing by more sensitive patients.

Although some prior bathing structures are of a walk-in variety, having a lateral opening and a sealing door, patients cannot be easily transferred directly into these bathing units from a sitting position, such as from a wheelchair or the like. Rather, the patients must be lifted to a standing, or partially erect position, and then bodily moved into the bathtub. Further, the seals on the closures for such bathing units are quite complex, expensive, and deteriorate quickly.

SUMMARY OF THE INVENTION

One aspect of the present invention is a bathtub having a lateral opening in one side of sufficient size to permit invalid ingress and egress therethrough. The opening is defined by a lip, and has a generally wedge-shaped contour which opens upwardly. A door selectively closes the opening, and includes a sealing edge with a generally wedge shape which conforms with the countour of the lip. A compression seal is connected with the door sealing edge, and the door is vertically translated between an open position, wherein invalid movement through the opening is permitted, and a closed position, wherein the door and the bathtub converge to compress the seal between the lip and the door edge and form a durable, reliable and uncomplicated seal which permits the bathtub to be filled to a level substantially above the base of the opening for immersal bathing of the invalid.

Another aspect of the present invention is a bathing apparatus for invalids, comprising a bathtub with a lateral opening and a sealed door selectively closing the opening. The door is slideably mounted on a pair of tracks disposed on opposite sides of the door, whereby the door is vertically translated upwardly from the closed position, and rotated into a substantially horizontal, overhead, storage position.

Yet another aspect of the present invention is a combination shower and bath unit, comprising an enclosure with a bathtub and shower walls upstanding from both ends and a rearward side of the tub to form a stall. The bathtub includes a raised seat portion, a back extending generally upwardly from the seat, and a foot portion positioned below and forwardly of the seat. The seat has an anatomical contour which forms a chair shape for supporting an invalid in a seated position in the bathing unit. The bathtub includes a lateral opening and sealed door arrangement to permit easy access to the unit. At least one shower head is mounted on one of the stall walls, and is oriented toward the seated invalid, whereby the unit is capable of both immersal bathing and showering the invalid for hygiene and therapy. The bathtub seat is preferably disposed at an elevation substantially commensurate with the seat of a conventional wheelchair, so that the invalid may be laterally transferred onto the seat. Also, the entire side of the bathtub is bodily removable so as to fully expose the bathtub seat and thereby facilitate shifting the patient into the bathtub unit from a wheelchair.

Yet another aspect of the present invention is a method for bathing invalids, comprising removing a lateral door from a bathing unit to fully access an open side, and positioning a wheelchair parallel with the bathing unit and beside an exposed seat portion of the tub. The arm of the wheelchair disposed closest to the bathtub is removed, and the attendant grasps the upper body of the invalid and lifts him slightly upwardly to remove his weight from the wheelchair seat, and simultaneously laterally shifts the invalid from the wheelchair onto the bathtub seat by translating the invalid along a slightly arcuate, horizontal path, which permits the attendant to keep his feet fixed in position adjacent the base of the bathtub, and maintain the weight of the invalid close to the attendant's body. When the attendant has set the invalid down, the invalid is seated at an angle to the longitudinal centerline of the bathtub, with his feet hanging over the outer edge of the seat portion, whereby the far side of the bathtub acts as a backrest for supporting and confining the invalid in the seat. The legs of the invalid are then lifted slightly and rotated into the foot portion of the bathtub, thereby simultaneously rotating the torso of the invalid into substantial alignment with the bathtub. The door is then replaced in the bathtub opening, thereby forming a watertight seal therebetween for either shower or immersal bathing of the patient.

The principal objects of the present invention are to provide a bathing apparatus for invalids, comprising a vertically sliding, wedge shaped door and lateral opening to facilitate access to the bathtub, with a compression seal which is quite durable, relatively uncomplicated and inexpensive, and sufficiently effective to remain watertight even when the tub is filled to a level substantially above the base of the opening for immersal bathing of the invalid. The bathtub has a chair-shaped, anatomical contour, with integral armrests, so that the patient can be comfortably bathed by either shower or immersion. The entire side of the bathtub opens to fully expose the seat and back, and thereby facilitate positioning the patient therein. The door is mounted on a counterbalance, overhead, track assembly for accurate positioning of the door, and greatly reducing the floor space required to operate the unit. Shower stall walls extend around the bathtub on three sides thereof, and include a plurality of shower heads mounted thereon, so that the patient can be bathed by either shower or immersion for hygiene and therapy. The shower heads are arranged so that they can be used to warm the tub before the patient is seated therein. An inset is provided in a foot well portion of the bathtub, so that an attendant can easily transfer the patient from a wheelchair onto the tub seat, while maintaining the patient's weight near the attendant's body to reduce strain. A concave notch is located in the door directly above the tub foot well to facilitate cleansing the patient's feet and legs. A channel is provided in the medial portion of the seat, with a water spray head mounted therein for cleansing the patient's perineal area.

These and other features, advantages and objects of the present invention will be further understood and appreciated by those skilled in the art by reference to the following written specification, claims and appended drawings.

DETAILED DESCRIPTION OF THE PREFERRED EMBODIMENTS

Figure 1:
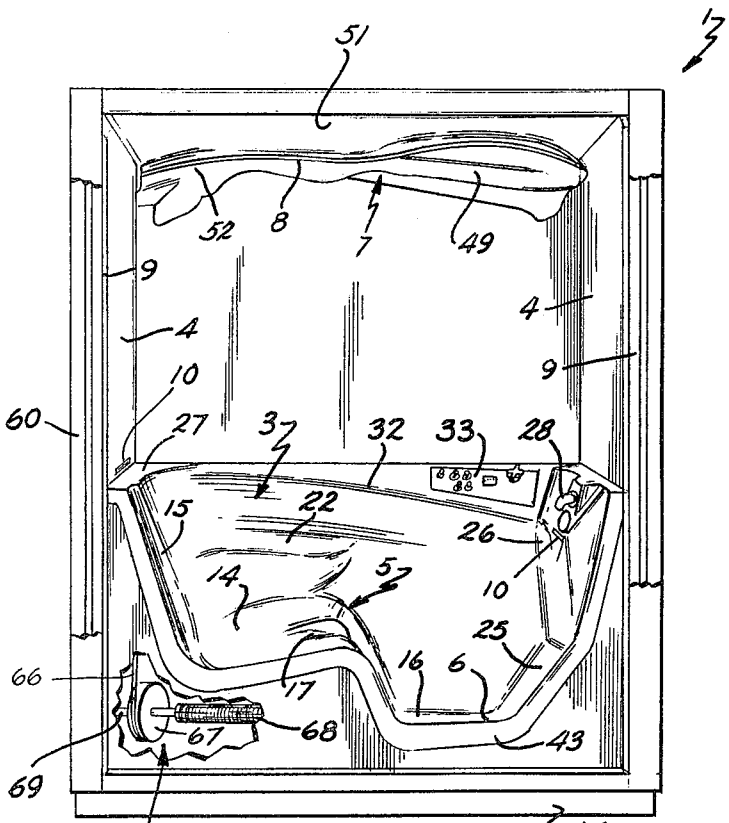
FIG. 1 is a perspective view of a bathing unit embodying the present invention taken from the front thereof, with a door shown in an overhead storage position, and portions of the unit broken away to reveal internal construction.

For purposes of description herein, the terms "upper," "lower," "right," "left," "rear," "front," "vertical," "horizontal" and derivatives thereof shall relate to the invention as oriented in FIG. 1. However, it is to be understood that the invention may assume various alternative orientations, except where expressly specified to the contrary.

The reference numeral 1 generally designates a bathing unit embodying the present invention, comprising an enclosure 2 with a bathtub 3 and upstanding walls 4 which form a shower stall. Bathtub 3 includes a seat 5 having an anatomical contour, and is split vertically adjacent the outer edge to form a lateral opening or face along lip 6 to permit invalid ingress and egress. A door 7 with a generally wedge-shaped contour mates with and selectively closes the bathtub opening, and includes a compression seal 8 along its bottom edge which is compressed when the door is closed, and forms a seal which is sufficiently leakproof to permit immersal bathing of an invalid disposed on the bathtub seat 5. Door 7 is slideably mounted on a hingeless track assembly 9, which vertically translates the door into the closed position (FIG. 2) and pivots the door as it is raised into a horizontal, overhead storage position (FIG. 1). Shower heads 10 are mounted on the stall walls 4 to provide both shower and immersal bathing for hygiene and therapy. The bathtub seat 5 and the tub opening are mutually oriented to permit an attendant to laterally move an invalid directly from a wheelchair onto the bathtub seat with minimum strain and hazard.

Figure 3:
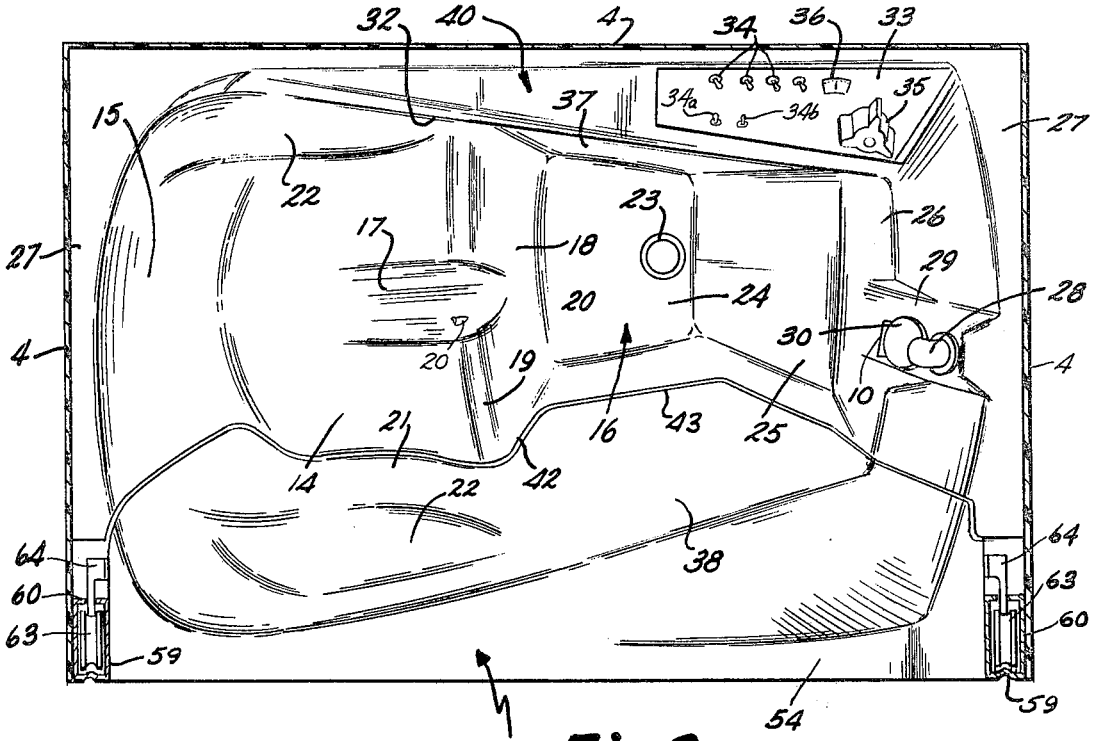
FIG. 3 is a perspective view of the bathing unit taken from the top and slightly forwardly thereof, with the door shown in a closed position, and upstanding sidewalls broken away.
Figure 5:
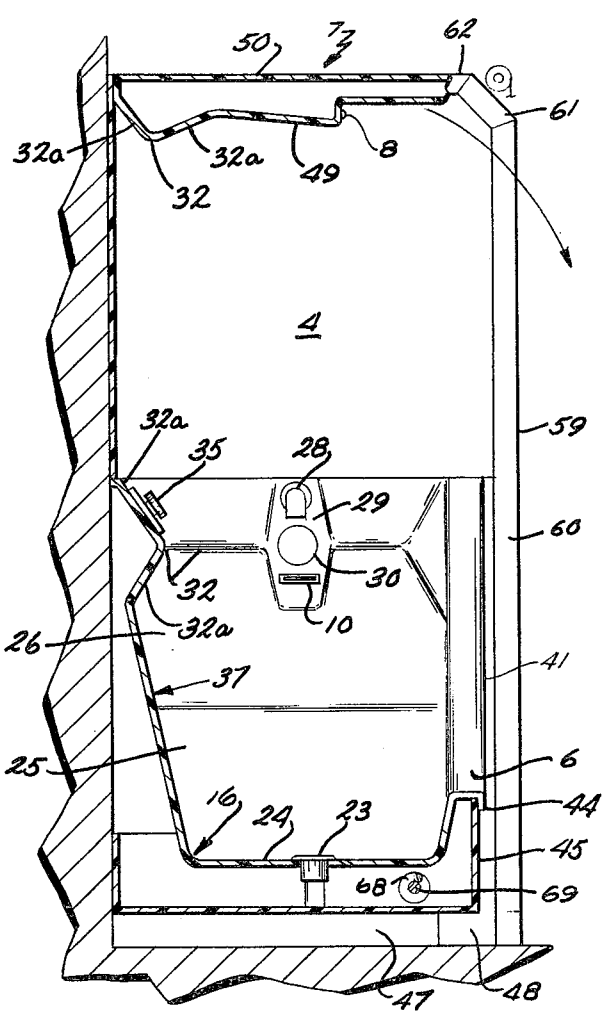
FIG. 5 is a vertical cross-sectional view of the bathing unit taken along the line V—V, FIG. 2.
Figure 4:
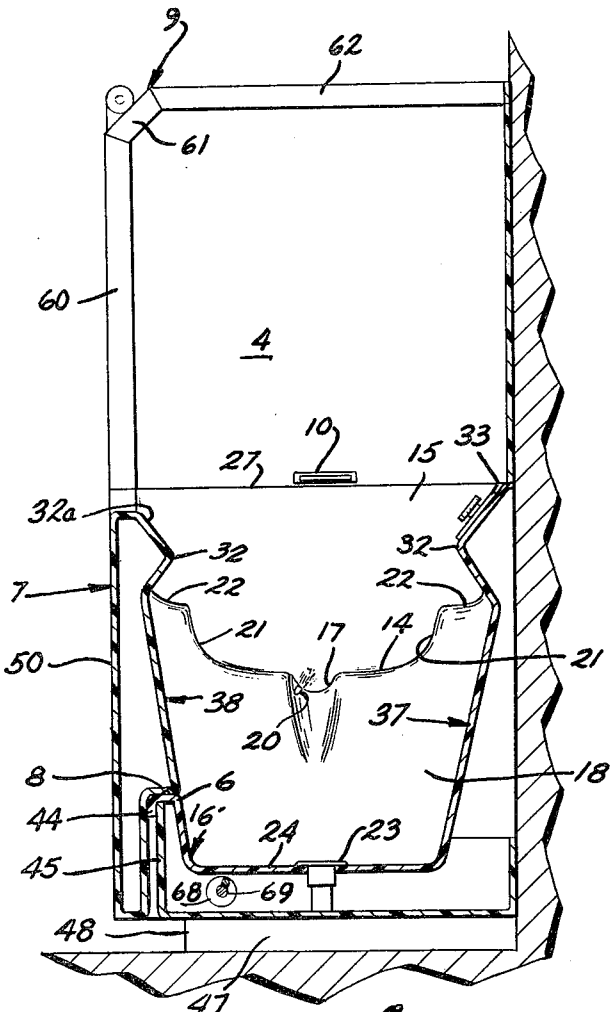
FIG. 4 is a vertical cross-sectional view of the bathing unit taken along the line IV—IV, FIG. 2.

The bathtub 3 (FIG. 1) comprises a seat 14, a back 15, and foot well 16, which are integrally molded in one piece from a durable, rigid, non-corroding material, such as fiberglass or the like. The seat 14 is disposed at an elevation substantially coextensive with that of a conventional wheelchair, and is inclined slightly to the rear. As best illustrated in FIGS. 3 and 4, a U-shaped trough or channel 17 is disposed in the medial portion of seat 14 and oriented longitudinally therein. Trough 17 extends from the middle of seat 14 through wall 18 at the forward edge 19 of the seat, and is anatomically shaped and positioned to expose the perineal area of a bather sitting on the seat. A spray nozzle 20 is mounted in one side of trough 17 with the discharge orifice oriented generally upwardly and is activated to gently cleanse the perineal area of the invalid's body. The forward edge 19 of the seat is rounded, and the rearward edge is arcuately shaped and blends smoothly with back 15. As best illustrated in FIG. 4, seat 5 includes lateral sidewalls 21 which extend upwardly from the seat 14 and include ledges 22 which form arm rests for the bather. Back 15 (FIG. 1) is angled slightly rearwardly, so that the patient is seated in a slightly reclined position in the bathing unit. The foot well 16 is disposed below and forwardly of seat 14, and as best illustrated in FIGS. 3–5, is a shallow reservoir with a drain 23 mounted therein. Foot well 16 tapers inwardly toward the front of the bathtub, and includes a base 24 having a substantially trapezoidal shape. An upwardly inclined kick wall 25 extends from the forward edge of base 25, and a front panel 26 extends therefrom to the upper edge or rim 27 of the bathtub. Front panel 26 (FIG. 1)

has a bifurcated construction which protrudes forwardly toward the seat and includes a substantially triangular side elevational shape forming the forward portion of a splash guard or rail, described in detail below. A spout 28 (FIG. 5) is mounted in a vertical cavity or depression 29 in the front splash guard, and is plumbed to deliver water to the bathing unit. An overflow drain 30 is mounted in depression 29 directly below spout 28, and prevents the water level in the tub from rising above the drain. An inwardly protruding rim 32 (FIGS. 4 and 5) extends around the front and sides of the tub, and forms a splash guard or rail to prevent water from spilling over the sides of the tub, particularly when the unit is used with a hydromassager (not shown). Rim 32 is formed by a pair of inclined ledges or walls 32*a*, which are integrally joined at a rounded edge. The upper legs 32*a* on the left-hand side of the tub provide a surface on which a control panel 33 is mounted. In this example, control panel 33 includes three hydraulic toggle valves 34 which individually control the flow of water through shower heads 10 and nozzle 20. A main valve 35 controls the flow of water through spout 28 and shower heads 10, and an automatic mixer 36 controls the temperature of the water emitted from either the spout or the shower heads. The tub also includes left and right-hand sidewalls 37 and 38 respectively, which extend upwardly from the side edges of base 24 to rim 27, blend integrally into the armrest walls 21 and 22, and kick wall 25, and include the associated portion of splash rail 32.

As best illustrated in FIG. 3, bathtub 3 has a symmetrical top plan shape, and is vertically split, so as to define a stationary half 40 in which seat 14, back 15 and foot well 16 are located, and a movable half, consisting of door 7, which is bodily removable from stationary half 40 to access opening 41 through which the bather enters and exits the unit. The part 42 between stationary tub half 40 and door 7 extends through rim 27 at the forward end of the tub, vertically downwardly through the outer tub side 38 at a location slightly outwardly and upwardly from the front and base walls 24–26, such that foot well 16 is an integrally formed, rather shallow, watertight reservoir. Part 42 extends from the rearward portion of foot well 16 vertically upwardly along the intersection of back wall 18 and sidewall 38, and then extends rearwardly along seat 14, slightly inwardly of the intersection of seat 14 and the wall 21 forming the side of the right-hand armrest 22. Part 42 then extends upwardly along back 15 to the rear of rim 27.

Lip 6 extends along part 42 and defines the opening 41 through which the bather ambulates to access the tub. Opening 41 and lip 6 are generally wedge-shaped, as viewed in side elevation, and open upwardly. The term "wedge-shaped" as used herein refers to the mutual orientation of the various portions of lip 6, wherein opposing sides of the lip are not parallel, but rather diverge in an upwardly direction. The opening 41 is disposed parallel with the sides of seat 14, so that an invalid can be shifted laterally onto the tub seat from a sitting position. Lip 6 includes a depending flange 44 (FIGS. 4 and 5) which extends over the upper edge of a side panel 45 disposed on the exterior side of the stationary tub half 40. The location of part 42 along the outer side edges of the back and seat provides full, unhindered access to the tub seat 5 to facilitate placing a bather in the unit, as described in greater detail hereinafter.

As best illustrated in FIG. 3, the location of part 42 along the base 24 of foot well 16 forms a lateral inset at that area which is shaped to provide access for the leg of an attendant, so that the attendant can maintain the weight of the invalid close to his body, as well as near the center of the seat, when an invalid is being shifted between the tub and a wheelchair. Also, the entire bathing unit 1 is raised on a frame 47 to form a toe space 48 along the front of the unit which allows the attendant to position his feet closer to the center of seat 14 for reducing the physical strain and safety hazards normally associated with patient transfer. Because the tub has a rather large head of water when full, drain 23 preferably includes a valve which is hydraulically operated by a remote toggle valve 34*a*, mounted on control panel 33. Toggle valve 34*b* controls a second valve (not shown) which directs the pressurized water from the mixer to either spout 28 or the shower heads 10. A hand-held shower wand (not shown) may also be provided to facilitate washing the hair of the invalid and other similar uses.

Door 7 (FIGS. 1 and 2) has a substantially planar exterior side 50 and an interior side 51 with a portion of the tub interior molded integrally therewith to mate with the contour of the stationary tub half 40 when the two halves are converged vertically. The contoured interior surface 49 on door 7 includes the right-hand armrest 22 (with respect to a seated bather), the right-hand side 38 of the tub, and the outer portion of splash rail 32 and tub rim 27. The contoured door surface 49 projects from door interior 51, and includes a sealing edge 52 along its margin with an outer, marginal ledge or relief 52*a* (FIG. 7) in which a compression seal 53 is mounted by means such as an adhesive. Sealing edge 52 has an upwardly opening, wedge shape which conforms with the contour of lip 6. As best illustrated in FIG. 2, the rim 27 along door 6 includes a notch or indentation 54 disposed directly above the tub foot portion 16 to improve attendant access to the feet and legs of the bather.

Figure 6:
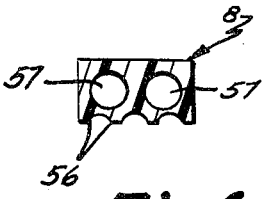
FIG. 6 is a lateral cross-sectional view of a compression seal.
Figure 7:
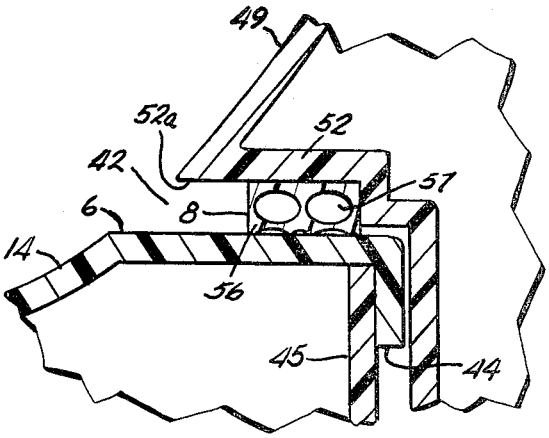
FIG. 7 is a fragmentary vertical cross-sectional view of the bathing unit showing the seal compressed in a closed door position.

With reference to FIGS. 6 and 7, the illustrated compression seal 8 has a rectangular lateral cross-sectional shape, with ribs or beads 56 extending longitudinally along the lower surface of the strip to facilitate sealing contact with lip 6. Seal 8 includes a pair of centrally disposed channels 57, and is constructed from a durable, resiliently compressible material such as a closed celled foam like neopreme. The seal is mounted in relief 52*a*, and is laterally flexible to follow the contour of sealing edge 52.

Figure 2:
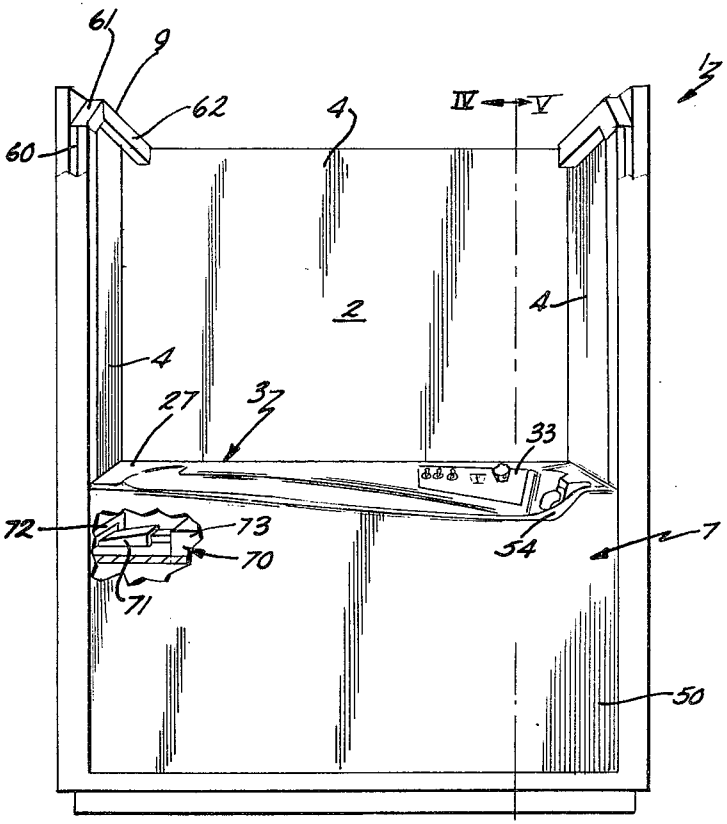
FIG. 2 is a front perspective view of the bathing unit, with the door shown in a closed position, and portions of the unit broken away.

The track assembly 9 (FIGS. 1 and 2) to which door 7 is slideably mounted verticaly translates the door into the closed position shown in FIG. 2, and pivots the door as it is raised into a horizontal, overhead storage position, as shown in FIG. 1. In this example, rails 59 (FIG. 5) are attached to the sidewalls 4 of the enclosure, and have a generally inverted L-shape, with front rail sections 60 extending along the forward edge of the stall walls, angled, interconnecting segments 61, and horizontal segments 62 which extend rearwardly over the tub along the upper edge of the stall sidewalls. Rail segments 60–62 are interconnected by means such as welds to form a rigid structure having a generally U-shaped transverse cross-sectional shape (FIG. 3). Each end of door 7 includes a pair of rollers 63 respectively mounted at the upper and lower edges thereof by a bracket 64. Rollers 63 are positioned inside the associated rails 59, and thereby slideably mount the door on the rails. In the closed position, track assembly 9 retains door 7 in a substantially vertical orientation, so that the door converges abuttingly against lip 6 in a vertical plane. By lifting door 7, the door is translated on the track assembly in a vertical plane, until the upper rollers 63 engage the inclined track segment 61, at which time further door translation pivots the door into a substantially horizontal orientation directly over the tub, thereby providing an overhead door arrangement which requires minimum floor space for operation. The height of horizontal rail segments 63 is selected so that the door, when fully open, is disposed well above the head of either the attendant or the bather. A counterbalance mechanism 65 (FIG. 1) is attached to door 7, and assists in raising the door to the overhead position, as well as retaining the door stationary in any selected position. In this example, counterbalance assembly 65 comprises a flexible cable 66 attached to the lower edge of door 7, extending in rails 59, and wound about an axle mounted drum 67 with a torsional coil spring 68 mounted on the axle 69.

A lock 70 (FIG. 2) is provided to positively retain door 7 in the closed position, with seal 8 compressed firmly between door edge 52 and tub lip 6 to form a waterproof seal. In this example, lock 70 comprises a pair of wedge-shaped bolts 71 mounted in opposite sides of door 7 which are received in associated plates 72 anchored in the tub sidewalls. To lock door 7 closed, bolts 71 are extended outwardly into plates 72 by means such as an electrically activated solenoid 73, a mechanical foot pedal, or the like. Abutment between wedge bolt 71 and plate 72 both forces door 7 downwardly to further compressing seal 8, and positively locks the door in the closed position. It is to be understood that the present invention also contemplates other means for securely locking the door closed.

Bathing apparatus 1 can be manufactured as either a freestanding unit, or as a structure to be built into a building. The front shower head 10 (FIG. 5) is mounted in recess 29 directly below overflow drain 30, and is fan-shaped to spray water on the invalid from his chest to his feet. The rear shower head 10 (FIG. 4) is mounted centrally in rear stall wall 4, such above rim 27, and has a spray pattern designed to impinge upon the neck and the upper back portion of the invalid which projects over rim 27.

In the bathing of an invalid, the attendant preferably initially warms the tub by turning on shower heads 10 with door 7 in the closed position. After the bathtub walls have been warmed to a comfortable temperature, the attendant turns off the water, unlocks door 7, and raises the door to the overhead storage position shown in FIG. 1. The invalid, who is typically seated in a wheelchair, (not shown), or other conveyance device, is then positioned along side the open bathing unit, with the chair wheels in a parallel relationship with the open side of the bathtub, and disposed directly beside seat 14 with the invalid facing forwardly. The arm of the wheelchair disposed closest to the bathtub is then removed or folded down, and the attendant positions himself facing the invalid, placing his right foot in inset 43, with his toe extending into toe space 48, and his left foot laterally offset from his right foot a comfortable distance, so as to provide a secure, comfortable stance. The attendant then grasps the upper body of the invalid, and lifting upwardly, raises the patient only a distance sufficient to remove his weight from the wheelchair seat, and simultaneously shifts the invalid laterally from the wheelchair onto the bathtub seat portion 5. During this shifting, the invalid is translated along a slightly arcuate, horizontal path which permits the attendant to keep his feet fixed or planted in position adjacent the base of the bathtub, and thereby maintain the weight of the invalid close to his body so as to alleviate strain and hazard. The pivoting motion of the attendant as he shifts the patient from the wheelchair seat onto the bathtub seat is the natural twisting action of this body. When the attendant sets the invalid down, the latter is seated at an angle to the longitudinal centerline of the bathtub, with his feet hanging over the outer edge of the seat 14. As the attendant sets the patient down into this position, the inner side 37 of the bathtub, along with the left-hand armrest 22, acts as a backrest, to support and confine the invalid in the bathtub seat. The attendant then lifts the legs of the invalid over the outer edge of the bathtub foot well 16, and rotates his feet into the foot well, thereby automatically and simultaneously rotating the torso of the invalid into a substantially aligned orientation with the longitudinal centerline of the bathtub. The patient is then maneuvered laterally squarely onto the seat, and door 7 is pulled downwardly into the closed position and locked securely in place.

In the event the arm of the wheelchair is fixed, or otherwise cannot be removed, the attendant must lift the invalid into a partially erect position, a sufficient height off of the wheelchair seat that his body will pass over the wheelchair arm. In a manner similar to that described hereinabove, the attendant then simultaneously lowers and pivots the patient from this partially erect position onto the bathtub seat.

If the invalid is ambulatory, he merely seats himself on seat 14, in substantially the same position described above when the attendant places non-ambulatory patients on the seat. An attendant will generally be required to at least supervise entry and exit from the bathing unit, as well as operate door 7.

After the bathing unit has been sealed closed, the attendant manipulates mixer 36 to adjust the temperature of the water to the desired level. Drain control 30 is manipulated to close the drail for immersal bathing of the invalid, and is generally kept open for showering the invalid. Control valve 35 is manipulated attendant to open the flow of water into the bathtub through spout 28. The shower heads 10 are individually activated by shifting toggle switches 34. Bathing of the perineal area is accomplished by manipulation of toggle valve 34*a*. The door notch 54 facilitates access by the attendant to the legs and feet of the bather.

After the invalid has been bathed, the attendant unlocks the door and lifts the same upwardly into the overhead storage position (FIG. 1). The patient's feet are swung outwardly from foot well 16, so that his legs extend over the outer edge of the seat. The patient is then laterally shifted by the attendant back onto the wheelchair seat by reversing the steps employed to place the patient into the bathtub.

The upwardly oriented wedge-shaped bathtub opening and door employ a relatively uncomplicated inexpensive compression seal which is quite durable, and sufficiently effective to maintain the bathtub watertight, even when water is filled in the tub to a level substantially above the base of the bathtub opening for immersal bathing of the invalid. The chair-shaped, anatomical contour of the bathtub allows the invalid to rest comfortably while being bathed, and the entire side of the bathtub opens to fully expose the seat and back and thereby facilitate positioning the patient in the tub. The door is slideably mounted on a counterbalance, overhead track assembly, thereby greatly reducing the floor space required to operate the unit, and accurately positioning the door in a sealing relationship with the bathtub lip. The shower stall walls with multiple shower head arrangement permit the patient to be bathed by either shower or immersion for hygiene and therapy. The inset and toe space at the foot well of the tub allows the attendant to transfer the bather to and from a wheelchair with a natural pivoting motion, while maintaining the weight of the patient near the attendant's body to reduce strain.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. A bathing apparatus for invalids, comprising:

a bathtub having a lateral opening in a side thereof with sufficient size to permit invalid ingress and egress therethrough; said lateral opening being defined by a lip, and having a generally wedge-shaped contour which opens upwardly;

a door selectively closing said opening, and having a sealing edge with a generally wedge shape which conforms with the contour of said lip;

a compression seal connected with one of said lips and said door sealing edge;

means for vertically translating said door between an open position wherein invalid movement through said opening is permitted, and a closed position wherein said door and said bathtub are converged to compress said seal between said lip and said door sealing edge and form a seal therebetween which is leakproof when said bathtub is filled with water to a level substantially above a base portion of said lip for immersal bathing of an invalid; and means for selectively locking said door in the closed position.

2. A bathing apparatus as set forth in claim 1, wherein:

said door is slideably mounted on a pair of inverted, generally L-shaped tracks, which are supported on opposite sides of said door and oriented to translate said door vertically into the closed position, and rotate said door as it is raised from the closed position into a substantially horizontal, overhead storage position directly over said bathtub.

3. A bathing apparatus as set forth in claim 1, wherein:

said opening comprises an entire side of said bathtub which extends from a front wall to a rear wall thereof to facilitate ingress and egress therethrough.

4. A bathing apparatus as set forth in claim 1, wherein:

said bathtub includes a seat portion disposed at an elevation substantially commensurate with the seat of a conventional wheelchair, a back portion extending generally upwardly from said seat portion, and a foot portion disposed below and forward of said seat portion; said seat, back and foot portions having an anatomical shape for supporting an invalid in a seated position; and said opening extends along the entire side of said bathtub, exposing said seat, back and foot portions, for laterally shifting the invalid from a wheelchair disposed beside said bathing apparatus onto said bathtub seat portion.

5. A bathing apparatus as set forth in claim 1, including:

a plurality of shower heads mounted about an upper portion of said bathtub.

6. A bathing apparatus as set forth in claim 1, wherein:

said bathtub lip includes a lateral inset at said base portion shaped to provide access for the leg of an attendant to facilitate shifting the invalid to and from said seat portion; and said door carries a contoured portion of the interior of said bathtub thereon.

7. A bathing apparatus as set forth in claim 2, wherein:

said bathtub includes a seat portion disposed at an elevation substantially commensurate with the seat of a conventional wheelchair, a back portion extending generally upwardly from said seat portion, and a foot portion disposed below and forward of said seat portion; said seat, back and foot portions having an anatomical shape for supporting an invalid in a seated position; and said opening extends along the entire side of said bathtub, exposing said seat, back and foot portions, for laterally shifting the invalid from a wheelchair disposed beside said bathing apparatus onto said bathtub seat portion.

8. A bathing apparatus as set forth in claim 7, wherein:

said bathtub lip includes a lateral inset at said foot portion, shaped to provide access for the leg of an attendant to facilitate shifting the invalid to and from said seat portion; and said door carries a contoured portion of the interior of said bathtub thereon.

9. A bathing apparatus as set forth in claim 8, including:

a plurality of shower heads mounted about an upper portion of said bathtub.

10. A bathing apparatus for invalids, comprising:

a bathtub having a lateral opening in one side thereof with sufficient size to permit invalid ingress and egress therethrough;

a door selectively closing said bathtub opening;

means for forming a seal between said door and said bathtub when said door is in a closed position which is leakproof when said bathtub is filled with water to a level substantially above a base portion of said opening for immersal bathing of an invalid;

a pair of tracks supported on opposing sides of said door, and extending vertically upwardly above said bathtub and rearwardly thereof over said bathtub;

means for slideably mounting said door on said tracks and vertically translating said door upwardly from the closed position, and rotating said door as it is raised into a substantially horizontal, overhead storage position directly over said bathtub.

11. A bathing apparatus as set forth in claim 10, including:

means for counterbalancing the weight of said door, whereby said door will remain stationary in substantially any position in which it is placed.

12. A bathing apparatus as set forth in claim 11, wherein:

said tracks have an inverted, generally L-shaped configuration.

13. A bathing apparatus as set forth in claim 10, wherein:

said tracks have a horizontal segment in which said door is supported in the storage position; and said horizontal track segments are disposed at an elevation which retains said door slightly above the height of the average invalid and attendant.

14. A bathing apparatus as set forth in claim 10, wherein:

said slideable door mounting means includes two pairs of rollers disposed in opposite tracks and attached to side edges of said door at upper and lower portions thereof.

15. A bathing apparatus as set forth in claim 14, including:

means for counterbalancing the weight of said door, whereby said door will remain stationary in substantially any position in which it is placed.

16. A bathing apparatus as set forth in claim 15, wherein:

said bathtub includes a lateral inset shaped to provide access for the leg of an attendant to facilitate shifting the invalid to and from said seat portion; and said door carries a contoured portion of the interior of said bathtub thereon.

17. A bathing apparatus as set forth in claim 16, wherein:

said tracks have an inverted, generally L-shaped configuration.

* * * * *

UNITED STATES PATENT AND TRADEMARK OFFICE

CERTIFICATE OF CORRECTION

PATENT NO. : 4,346,485

DATED : August 31, 1982

INVENTOR(S) : Reed et al.

It is certified that error appears in the above—identified patent and that said Letters Patent is hereby corrected as shown below:

Column 2, line 12:

"countour" should be --contour--

Column 6, line 52:

"verticaly" should be --vertically--

Column 8, line 42:

"drail" should be --drain--

Column 8, line 44:

After "manipulated" insert --by the--

Signed and Sealed this

*Twenty-ninth* Day of *March 1983*

[SEAL]

*Attest:*

GERALD J. MOSSINGHOFF

*Attesting Officer*

*Commissioner of Patents and Trademarks*